United States Patent [19]

Weimar et al.

[11] 4,036,601

[45] July 19, 1977

[54] CORROSION-RESISTANT TURBINE BLADES AND METHOD FOR PRODUCING THEM

[75] Inventors: Peter Weimar; Franz Bauer, both of Karlsruhe, Germany

[73] Assignee: Gesellschaft fur Kernforschung m.b.H., Karlsruhe, Germany

[21] Appl. No.: 562,158

[22] Filed: Mar. 26, 1975

[30] Foreign Application Priority Data

Mar. 26, 1974 Germany ..... 2414641

[51] Int. Cl.[2] ..... B32B 15/00

[52] U.S. Cl. ..... 428/663; 228/173; 428/686

[58] Field of Search ..... 29/198, 194, 191, 191.4

[56] References Cited

U.S. PATENT DOCUMENTS

| | | | |
|---|---|---|---|
| 2,719,797 | 10/1955 | Rosenblatt et al. | 29/198 X |
| 3,157,482 | 11/1964 | Nero et al. | 29/198 X |
| 3,268,305 | 8/1966 | Hagadorn et al. | 29/194 X |
| 3,271,849 | 9/1966 | Price | 29/198 X |
| 3,547,600 | 12/1970 | Gwynn et al. | 29/194 |
| 3,578,743 | 5/1971 | Bradley et al. | 29/194 |
| 3,657,784 | 4/1972 | Selman et al. | 29/195 |

*Primary Examiner*—L. Dewayne Rutledge
*Assistant Examiner*—E. L. Weise
*Attorney, Agent, or Firm*—Spencer & Kaye

[57] ABSTRACT

A turbine blade includes a core made of a highly heat-resistant alloy and a highly heat-resistant, nonporous, corrosion-resistant, metallic protective cover fitted onto the core. The cover forms a gas-tight metallurgical bond with the core and has great strength, high ductility and a uniform layer thickness. The process includes the steps of preshaping a core of highly heat-resistant material and fitting the preshaped core into a substantially preshaped, corrosion-resistant and highly heat-resistant cover. The cover is welded to the core at a point which during later use is subjected only to little stress to form a vacuum-tight seal and workpiece. The workpiece is headed in a pressure vessel to a temperature of at least 1000° C, and the cover of the heated workpiece is heat-welded to the core by isotactic hot-pressing without the formation of pores.

12 Claims, 1 Drawing Figure

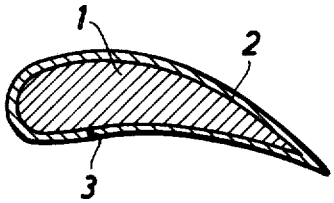
1
2
3

CORROSION-RESISTANT TURBINE BLADES AND METHOD FOR PRODUCING THEM

FIELD OF THE INVENTION

The present invention relates to corrosion-resistant turbine blades and a method for producing them.

BACKGROUND OF THE INVENTION

Gas turbines have been used for a long time in the production of aircraft. Occasionally, gas turbines have been used in tracks or as drive assemblies of vehicles travelling on tracks. The gas turbine, however, has not as yet been used in the vehicle in the vehicle which is one that is most prevalent in traffic, namely, passenger automoblies. The gas turbine has not been able to displace the internal-combusiton engine in passenger automobiles.

Compared to the internal-combustion engine, the gas turbine has some significant advantages. For example, the gas turbine has a favorable weight per horsepower, a smaller structural size than internal-combustion engines, very good torque characteristic, quiet operation, vibration-free operation, low maintenance, and modest fuel requirements.

The drawback of gas turbines thus far has been its poor economy in terms of output with respect to cost and coupled therewith a price that is too high.

The economy of operation can of course be improved if it is possible to obtain blade materials which have a use temperature which is higher than the presently possible maximum use temperature of 1050° C. This use temperature has been obtained with precipitation hardened materials but these materials lose their strength above this temperature due to decomposition of the structural states. Research in the ceramic field also has not revealed any suitable materials.

SUMMARY OF THE INVENTION

It is an object of the present invention to provide turbine blades of metallic combinations which do not have the drawbacks of the known blade materials.

It is another object of the present invention to provide turbine blades which made it possible to increase the permissible operating temperature to 1200° to 1300° C.

It is a further object of the invention to provide a process for manufacturing such turbine blades where the requirements with respect to the properties of the finished blades can be dependably met.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve the foregoing objects and in accordance with its purpose, this invention provides a turbine blade which comprises a core of a highly heat-resistant alloy an an unporous, corrosion-resistant and highly heat-resistant metallic protective cover fitted onto this core and forming a gas-tight metallurgical bond therewith. The cover has great strength, a high ductility and a uniform layer thickness.

In another aspect of the invention, a process is provided for producing corrosion-resistant turbine blade which comprises the steps of preshaping a core of highly heat-resistant material, fitting the preshaped core ito a substantially preshaped, corrosion-resistant and highly heat-resistant cover, welding the cover to the core at a point which during later use is subjected only to little stress to form a vacuum-tight seal and workpiece, heating the workpiece in a pressure vessel to a temperature of at least 1000° C, and heat-welding the cover to the core by an isostatic hot-pressing without the formation of pores.

It is to be understood that both the foregoing general description and the following detailed description are exemplary and explanatory, but are not restrictive of the invention.

DESCRIPTION OF THE DRAWING

The accompanying drawing illustrates an example of a presently preferred embodiment of the invention and together with the description serves to explain the principles of the invention.

The sole FIGURE of the drawing is a cross-sectional view of a turbine blade made in accordance with the teachings of the present invention.

DETAILED DESCRIPTION OF THE INVENTION

The turbine blade of the present invention contains a core of highly heat-resistant alloy. The core material desirably should have good oxidation resistance, a low specific weight, and good workability as evidenced by a relatively low transition temperature from brittle to ductile to enable the core to run under these extreme working conditions. A number of individual metals were considered for use as the core material but these metals suffered from one drawback or another. For example, chromium could be used with respect to its specific weight and its oxidation resistance, but its poor workability detracts from its usefulness. Tantalum has a low transition temperature, but suffers from a relatively high specific weight and a low oxidation resistance. Niobium is distinguished by a high melting point and an average specific weight, but suffers from a low oxidation resistance. Molybdenum could be used with respect to its specific weight, but suffers from a low oxidation resistance and a relatively high transition temperature. Tungsten does not provide any particularly useful properties.

Although individual metals by themselves have generally not been found suitable as a core material, certain alloy compositions have been found to be especially useful as core material, In one embodiment of the present invention, the core is made of a molybdenum-rhenium alloy having a rhenium content of from about 30 to 50 percent by weight, with the remainder of the alloy being molybdenum. In another embodiment of the invention, the core of the turbine blade is made of a niobium-molybdenum alloy having a molybdenum content of from about 5 to 20 percent by weight, with the remainder of the alloy being niobium.

In still another embodiment of the invention, the core can be made of a niobium-tungsten alloy having a tungsten content of from about 5 to 10 percent by weight, with the remainder of the alloy being niobium. In a further embodiment of the invention, the core can be made of a vanadium-titanium niobium alloy having a titanium content in the range of from about 1 to 10 percent by weight, a niobium content in the range of from about 5 to 20 percent by weight, with the remainder of the alloy being vanadium. In a still further embodiment of the invention, the core can be made of a vanadium-titanium-silicon alloy having the formula V-3Ti-1Si. The core of the turbine blade can be made for example, of molybdenum-rhenium alloys having contents of Mo 68 percent by weight and Re 32% by weight or Mo 62 percent by weight and Re 38% by weight or Mo 55 percent by weight and Re 45% by weight or preferrably Mo 50% by weight and Re 50% by weight. The 50 — 50 alloy remains ductile even at -200° C in the recrystallized condition. As a result, the 50 — 50 alloy can be fusion welded to itself forming completely ductile welds of an integrity hitherto unattainable with Mo, W and their alloys. The melting point of this alloy is approximately 2550° C.

Other useful alloys are:

niobium-molybdenum alloys having contents of
- Nb 95% by weight and Mo 5% by weight
- Nb 80% by weight and Mo 20% by weight niobium-tungsten alloys having contents of
- Nb 95% by weight and W 5% by weight
- Nb ca. 89% by weight and W 10% by weight and Zr 1% by weight (0,1% C)

vanadium-titanium-niobium alloys having contents of
- Ti 1% by weight and Nb 20% by weight, the remainder of the alloy being vanadium
- Ti 10% by weight and Nb 5% by weight, the remainder of the alloy being vanadium, or alloys of metals with a high melting point, such as
- Mo-Til-Zr (0,2 Zr; 0,15 C)
- Ta-W8-HfC
- W-3Re2THO$_2$ or cobalt alloys
- Co-CR27-Mo5 (0,25 C)
- Co-Cr22-W10-Ta9 (0,85 C)

or nickel alloys
- Ni-Cr15-Fe7-Ti2,5 (0,7 Al; 1 Nb)
- Ni-Cr19-Fe18-Nb5-Mo3 (0,6 Al; 0,9 Ti)

High melting point means in this connection: high above the working temperature of 1200° to 1300° C, the maximum amount of which is usefully 8/10 of the melting point temperature. Thus a high melting point means a melting point above 1650° C to 1700° C.

In the turbine blade of the present invention, the core is protected by a metallic cover which completely surrounds and encases the core and which is highly heat-resistant, nonporous, and corrosion-resistant. The cover is especially useful in providing the turbine blade with oxidation resistance. The metal of the protective metal cover should have a high melting point and be oxidation resistant in air at temperatures of about 1200° C. The metal of the protective metal cover preferaby is selected from the group consisting of rhenium, rhodium, iridium and platinum and any of these metals can be used with any of the above-described alloys. These metals have high melting points, and are oxidation-resistant in air at temperature of about 1200° C to 1300° C, and are corrosion-resistant at such temperatures. The use of protective metal covers that can withstand such temperatures makes it possible to increase the permissible operating temperature of the turbine blade to about 1200° C to 1300° C and thus enables the total efficiency of the turbine employing such a turbine blade to be substantially increased. This increase in the efficiency of the turbine, in part, compensates for the high specific costs for the materials of the turbine blade.

The metal cover that is applied to the core has great strength, a high ductility and a uniform layer thickness. The lower limit of the thickness of this cover is the thickness when the cover just meets the requirement for gas tightness and weldability. The maximum thickness of the cover often is limited by economic considerations. Further, the influence of the thickness on the mechanical properties of the turbine blade with respect to stresses from centrifugal forces and the operating medium also must be considered when determining the maximum thickness of the cover. Generally, the cover thickness will range from about 50μm to 500μm, and for example, can be about 100μm.

In the process of the present invention for producing corrosion resistant turbine blades, the core of highly heat-resistant material is preshaped by any conventional means to a desired turbine blade shape. The conventional shaping process for the core is the same as the process used for fabricating turbine blades; (1) casting, (2) hot working.

The preshaped core is then fitted into the cover which has also been substantially preshaped. This cover is then welded at a point which during later use is subjected only to little stress to form a vacuum-tight seal about the core (see page 7a). The workpiece comprising the core and the cover is then subjected to a leakage test in a known manner to determine whether or not the seal is, in fact, tight.

The leakage test preferably is performed by first immersing the workpiece into liquid nitrogen of a temperature of about −196° C. After temperature equilibrium in the liquid nitrogen has been established, the workpiece is removed from the liquid nitrogen and is reheated in an alcohol (e.g., methanol or ethanol) having a low boiling point and being at room temperature. If a leak is present, the quantity of nitrogen sucked in expands during the heating process and can be detected by the formation of bubbles. If no leak is present, the thus-established tight seal is entirely sufficient for the subsequent compression during the isostatic hot-pressing. Isostatic hot-pressing is a well known technique. This first welding step depends on the thickness of the clad, in any case the welding should be performed under an inert atmosphere. It is proposed: argonarc welding; electron beam welding, or laser welding.

When the tight seal has been confirmed, the workpiece is heated in a pressure vessel to a temperature of more than 1000° C and the cover is heat-welded to the core by an isostatic hot-pressing process without the formation of pores. Preferably, the hot-pressing is conducted for about one hour at a temperature of about 1200° to 1400° C and a pressure of from about 300 to about 1000 atmospheres. In contrast to the processes for producing turbine blades previously disclosed in the art, the process of the present invention heat-welds a metal foil as the protective cover to a highly heat-resistant core by means of an isostatic hot-pressing process in which the entire cover is hot-pressed to the core. The isostatic hot-pressing process is particularly suited for the application of metallic coverings to items having a complicated shape, such as, for example, spatially curved turbine blades.

The process according to the present invention is clearly superior to other processes regarding attainable uniform gastight layers. The application of such corrosion protection layers by, for example, plasma spraying or galvanic deposition does not promise success due to the gas permeability of such layers. Another process, the CVD (chemical vapor deposition) process has the drawback that thick layers (here at least 100μ) can be deposited only at very high cost.

The present invention will now be explained with the aid of a schematic representation of a turbine blade produced in a process according to the present invention.

The FIGURE is a cross-sectional view of a turbine blade. The core 1 of the turbine blade is produced of a highly heat-resistant alloy of a metal with a high melting temperature. Thereafter, this core is encased in a preshaped foil 2 (of about 100 μm thickness) of corrosion-resistant metal and is welded to form a vacuum-tight seal at a point 3 where the blade will be subjected to relatively little stress under operating conditions. The workpiece is then heat-welded by means of an isostatic hot-pressing process without the formation of pores. The pressing conditions for the combination of a niobium alloy as the core and rhodium for the cover, for example, are at a temperature of 1400° C at 600 atmospheres helium pressure for about 1 hour. The said noibium alloy can be, for example, Nb-W10-Zr 1 (0,1 C).

It will be understood that the above description of the present invention is susceptible to various modifications, changes and adaptations, and the same are intended to be comprehended within the meaning and range of equivalents of the appended claims.

What is claimed is:

1. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of a molybdenum-rhenium alloy having a rhenium content of from 30 to 50 weight percent, the remainder molybdenum, and the protective cover is made of a metal selected from the group consisting of rhenium, rhodium, iridium, and platinum, said metal having a high melting point and being resistant to oxidation in air at temperatures of about 1200° C.

2. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of a niobium-molybdenum alloy having a molybdenum content of 5 to 20 percent by weight, the remainder niobium, and the protective cover is made of a metal selected from the group consisting of rhenium, rhodium, iridium, and platinum, said metal having a high melting point and being resistant to oxidation in air at temperatures of about 1200° C.

3. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of a niobium-tungsten alloy having a tungsten content of from 5 to 10 percent by weight, the remainder niobium, and the protective cover is made from a metal selected from the group consisting of rhenium, rhodium, iridium, and platinum, said metal having a high melting point and being resistant to oxidation in air at temperatures of about 1200° C.

4. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of a vanadium-titanium-niobium alloy having a titanium content of from 1 to 10 percent by weight, a niobium content of from 5 to 20 percent by weight, the remainder vanadium, and the protective cover is made of a metal selected from the group consisting of rhenium, rhodium, iridium, and platinum, said metal having a high melting point and being resistant to oxidation in air at temperatures of about 1200° C.

5. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of a vanadium-titanium-silicon alloy of the formula V-3Ti-1Si and the protective cover is made of a metal selected from the group consisting of rhenium, rhodium, iridium, and platinum, said metal having a high melting point and a resistance to oxidation in air at temperatures of about 1200° C.

6. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of an alloy consisting essentially of Mo-Ti-Zr, and the protective cover is made of a metal selected from the group consisting of rhenium, rhodium, iridium, and platinum, said metal having a high melting point and being resistant to oxidation in air at temmperatures of about 1200° C.

7. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the core is made of an alloy consisting essentially of Ta-8W-HfC, and the protective cover is made of metal selected from the group consisting of rhenium, rhodium, iridium, and platinum, said metal having a high melting point and being resistant to oxidation in air at temperatures of about 1200° C.

8. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the alloy consists essentially of W-3Re-2$ThO_2$, and the protective cover is made of a metal selected from the group consisting of rhenium, rhodium, iridium, and platinum, said metal having a high melting point and being resistant to oxidation in air at temperatures of about 1200° C.

9. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the alloy consists essentially of Co-27Cr-5Mo, and the protective cover is made of a metal selected from the group consisting of rhenium, rhodium, iridium, and platinum, said metal having a high melting point and being resistant to oxidation in air at temperatures of about 1200° C.

10. Turbine blade comprising a core of a highly heat-resistant alloy and a highly heat-resistant, nonporous, corrosion-resistant, metallic protective cover fitted onto said core and forming a gas-tight metallurgical bond therewith, said protective cover havng great strength, high ductility and a uniform layer thickness, wherein the alloy consists essentially of Co-22Cr-10W-9Ta, and the protective cover is made of a metal selected from the group consisting of rhenium, rhodium, iridium, and platinum, said metal having a high melting point and being resistant to oxidation in air at temperatures of about 1200° C.

11. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the alloy consists essentially of Ni-15Cr-7Fe-2.5Ti, and the protective cover is made of a metal selected from the group consisting of rhenium, rhodium, iridium, and platinum, said metal having a high melting point and being resistant to oxidation in air at temperatures of about 1200° C.

12. Turbine blade comprising a core of a highly heat-resistant alloy and a highly heat-resistant, nonporous, corrosion-resistant, metallic protective cover fitted onto said core and forming a gas-tight metallurgical bond therewith, said protective cover having great strength, high ductility and a uniform layer thickness, wherein the alloy consists essentially of Ni-19Cr-18Fe-5Nb-3Mo, and the protective cover is made of a metal selected from the group consisting of rhenium, rhodium, iridium, and platinum, said metal having a high melting point and being resistant to oxidation in air at temperatures of about 1200° C.

* * * * *